US005813735A

United States Patent [19]

Wu

[11] Patent Number: 5,813,735

[45] Date of Patent: Sep. 29, 1998

[54] COMBINATION-TYPE HIDING SIDEBOARD WITH MOVABLE CABINETS

[76] Inventor: Chin-Jung Wu, No. 28-5, Chang-Der Street, Shu-Lin Town, Taipei Hsein, Taiwan

[21] Appl. No.: 705,047

[22] Filed: Aug. 29, 1996

[51] Int. Cl.[6] ..... A47B 97/00; A47B 53/02

[52] U.S. Cl. ..... 312/204; 312/200; 312/199; 312/330.1; 312/350

[58] Field of Search ..... 312/204, 201, 312/200, 198, 111, 298, 299, 317.3, 235.2, 235.5, 330.1, 350, 322

[56] References Cited

U.S. PATENT DOCUMENTS

| | | | |
|---|---|---|---|
| 1,055,109 | 3/1913 | Whitakere | 312/199 X |
| 2,166,704 | 7/1939 | Foulkes | 312/199 |
| 3,427,085 | 2/1969 | Staller | 312/200 |
| 3,446,546 | 5/1969 | D'Adamo | 312/204 X |
| 3,970,010 | 7/1976 | Cantley | 312/298 X |
| 4,256,355 | 3/1981 | Yamaguchi et al. | 312/200 X |
| 5,230,551 | 7/1993 | Kramer | 312/204 |
| 5,466,058 | 11/1995 | Chan | 312/111 |
| 5,588,727 | 12/1996 | D'Agaro et al. | 312/330.1 X |
| 5,597,219 | 1/1997 | Horn et al. | 312/322 X |

FOREIGN PATENT DOCUMENTS

| | | | |
|---|---|---|---|
| 1441681 | 5/1966 | France | 312/199 |
| 1189988 | 4/1970 | United Kingdom | 312/322 |

*Primary Examiner*—Jose V. Chen
*Assistant Examiner*—James O. Hansen
*Attorney, Agent, or Firm*—Bacon & Thomas

[57] ABSTRACT

Disclosed is a combination-type hiding sideboard with movable cabinets. The sideboard comprises a body and a plurality of movable cabinets. The space of the body is divided into a ornamental area and a hidden area which can not be seen and accessible to ordinary people when locked. Many articles can be stored in the hidden area so as not to be stolen by a thief.

9 Claims, 5 Drawing Sheets

COMBINATION-TYPE HIDING SIDEBOARD WITH MOVABLE CABINETS

FIELD OF THE INVENTION

This invention relates to a combination-type hiding sideboard with movable cabinets, more particularly to a sideboard having a body with a opening, the space in the body is divided into ornamental area and a hidden area which cannot be seen and accessible to ordinary people when locked, the sequence of the movable cabinets in the ornamental area can be changed by the intention of the user, and any precious articles can be hidden in the hidden area.

BACKGROUND OF THE INVENTION

General well-known sideboards are already combined and assembled. It is difficult to transport the well-known sideboards, and during the transportation, the well-known sideboards will collide with other object. Therefore, the surface of the sideboards will deteriorate. The shelves of the sideboard are of a single design structure and are used to exhibit ornamentals. If precious articles are disposed on the shelves, the thieves can easily steal them. Most families do not have enough equipment to save precious articles with their openings being not secure and concealed. Currently, the number of members of a family is not large, and the stealing crimes occur so often that the members will worry about the safety of the precious articles.

SUMMARY OF THE INVENTION

The inventor of present invention utilizes a recombining and dismantling design concept to construct the sideboard body when the user needs at a suitable place so as to facilitate the transportation of the sideboard of present invention. On the middle panel there are grooves extending at a right angle or parallel with each other. On the lower surface of top panel are directional slots. On the upper surface of a movable cabinet is a guiding protrusion. The movable cabinet on both sides of the sideboard can move inwardly or outwardly between an ornamental area and a hidden area. The movable cabinets in the ornamental area can move freely in the extending direction of the ornamental area. Therefore, the movable cabinets which have been fixed can hide and conceal the space of the hidden area and the movable cabinets in the hidden area.

It is an object of this invention to provide a combination-type hiding sideboard with movable cabinets, the body of which can be combined and dismantled if necessary so as to lower the transportation volume of the components and to facilitate the transportation before combination.

It is another object of this invention to provide a combination-type hiding sideboard the space of which is divided into an ornamental area and a hidden area by means of some moveable cabinets. By pulling and drawing, some movable cabinets are moved into the hidden area. Because the fixed movable cabinets in the ornamental area can hide and conceal the hidden area located in the rear part of the body, nobody can see or be accessible to the precious articles in the hidden area.

It is another object of this invention to provide a movable cabinet used in the sideboard of this invention. On the lower surface of the movable cabinet are wheels which are correspondent to the grooves disposed on the middle panel, and is which the wheels can rotate. On the upper surface of the movable cabinet is a guiding protrusion which can slide in the directional slot. Thereby the movable cabinet can move in the ornamental area in the extending direction or move inwardly or outwardly between the ornamental area and the hidden area.

BRIEF DESCRIPTIONS OF THE DRAWINGS

DETAILED DESCRIPTION OF THE INVENTION

Figure 1:
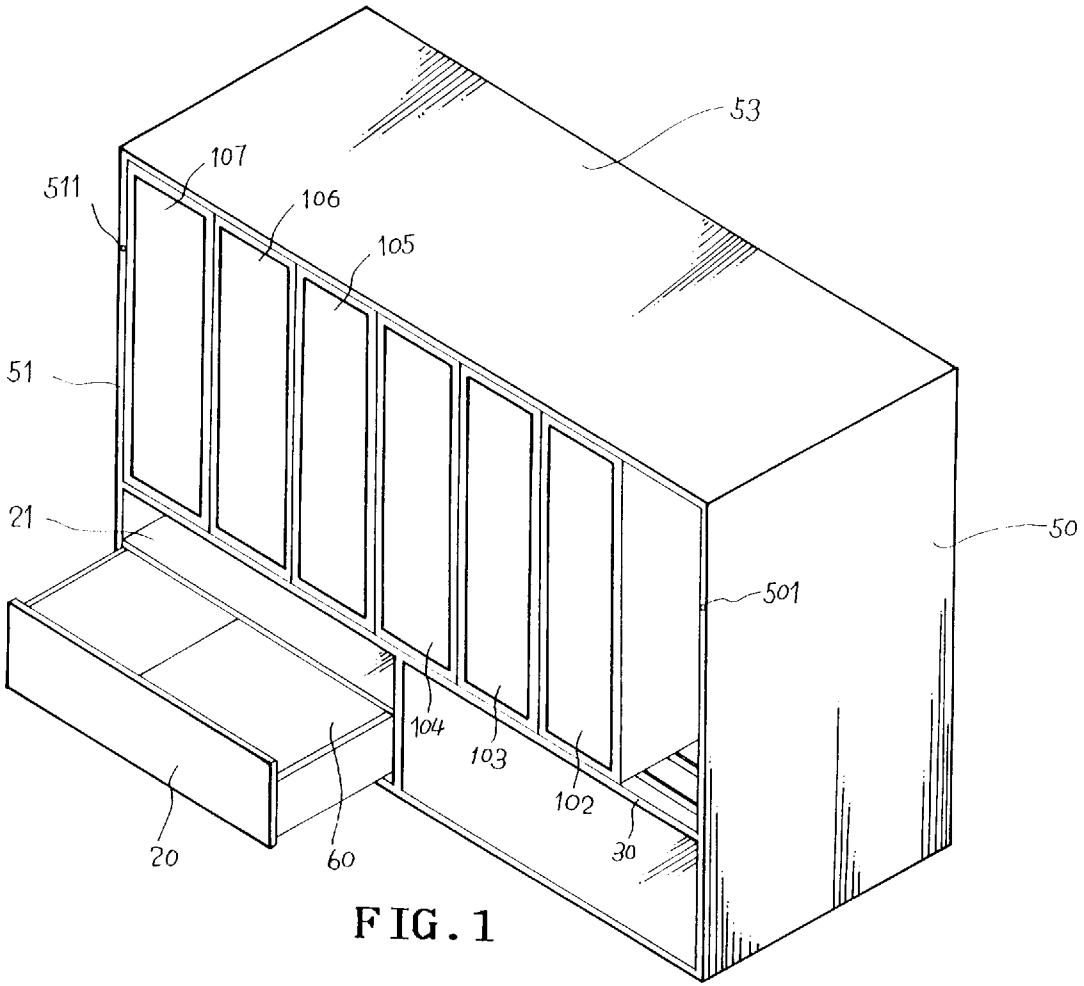
FIG. 1 is a partial diagrammatic view of the sideboard of the present invention.
Figure 2:
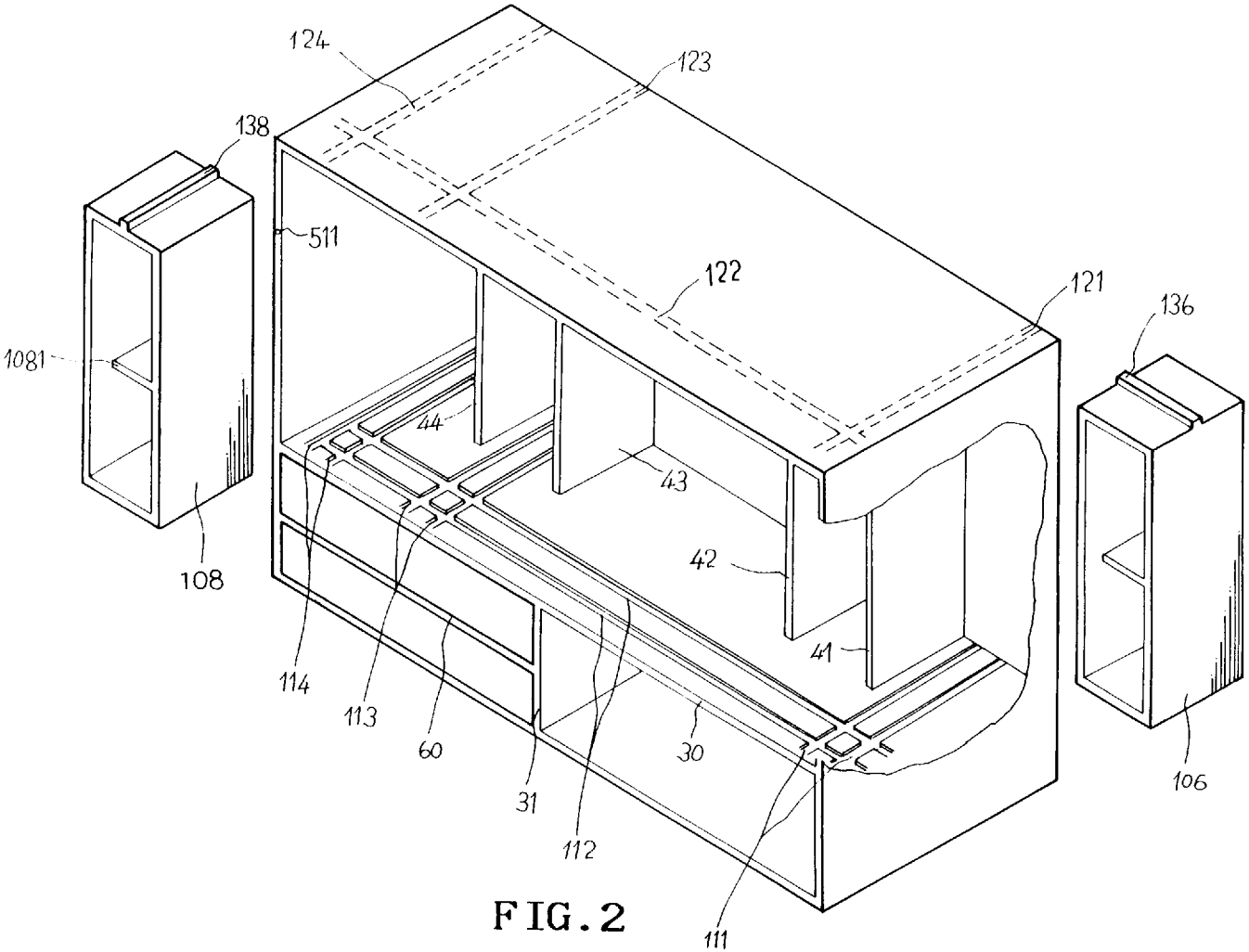
FIG. 2 is a schematic illustration of the sideboard of the present invention.
Figure 3:
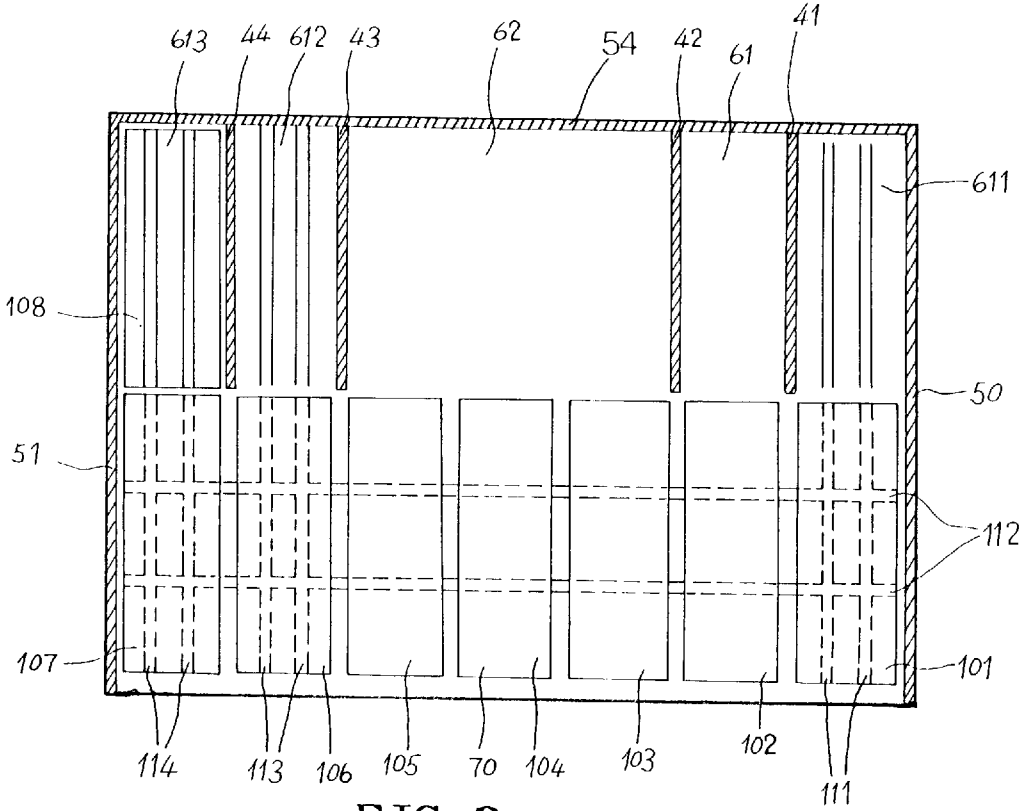
FIG. 3 is a top schematic view of the sideboard of the present invention.

Please see FIGS. 1–5, the combination-type hiding sideboard with movable cabinets of present invention comprises: a body which comprising a first side panel 50, a top panel 53, a second side panel 51, a seat panel 54, a middle panel 30, and a low panel, the body is combined from separated premade components; and a plurality of movable cabinets.

The space formed by the first side panel 50, the top panel 53, the second side panel 51 and the middle panel 30 is divided into an ornamental area 70 and a hidden area. The hidden area is separated into a first hiding chamber 611, a first hiding area 61, second hiding area 62, a second hiding chamber 612 and a third hiding chamber 613 by means of a first panel 41, a second panel 42, a third panel 43 and a fourth panel 44. By utilizing grooves 111, a first directional slot 121, third grooves 113, a third directional slot 123, fourth grooves 114 and a fourth directional slot 124, the movable cabinets of the present invention can move from the ornamental area to the hidden area. Further, the movable cabinets can move from the hidden area back to the ornamental area. The second grooves 112 extend in a direction substantially parallel to the plane of the opening. The first grooves 111, third grooves 113 and fourth grooves 114 extend in a direction substantially perpendicular to the plane of the opening.

The movable cabinets 101–108 are composed of a cabinet body. On one side edge of the opening of the cabinet body is a door which can be opened or closed by means of a hinge. On the lower surface of the cabinet body are wheels (not shown) which can rotate along the grooves in order to move the cabinets 101–108. On the upper surface of the cabinet body is a guiding protrusion 136 and 138. The movable cabinets 102–107 move along the second grooves 112 while the movable cabinets 101 and 108 respectively move along the first grooves 111 and the fourth grooves 114. When the movable cabinet 108 moves into the third hiding chamber 613 and the movable cabinet 107 moves left to the left position, the movable cabinet 107 is fixed by lock 511. Thus, precious articles are stored and hidden in the movable cabinet 108 in the hidden area. On the upper surface of the middle panel 30 are first grooves 111, third grooves 113 and fourth grooves 114 on which the wheels can move and rotate. The wheels of movable cabinets 101 and 108 move and rotate on grooves 111,113 and 114 so that the movable cabinets 101 and 108 can freely move between hidden area and ornamental area. The upper surface of the middle panel 30 in the ornamental area is second grooves 112 on which the wheels a of movable cabinets 102–107 can rotate so that the movable cabinets 102–107 can freely move in the ornamental area.

On the lower surface on the top panel 53 of the body of present invention are directional slots 121–124 useful for the insertion of guiding protrusions 136 or 138 so as to slide along the extending direction of the directional slots.

Figure 4:
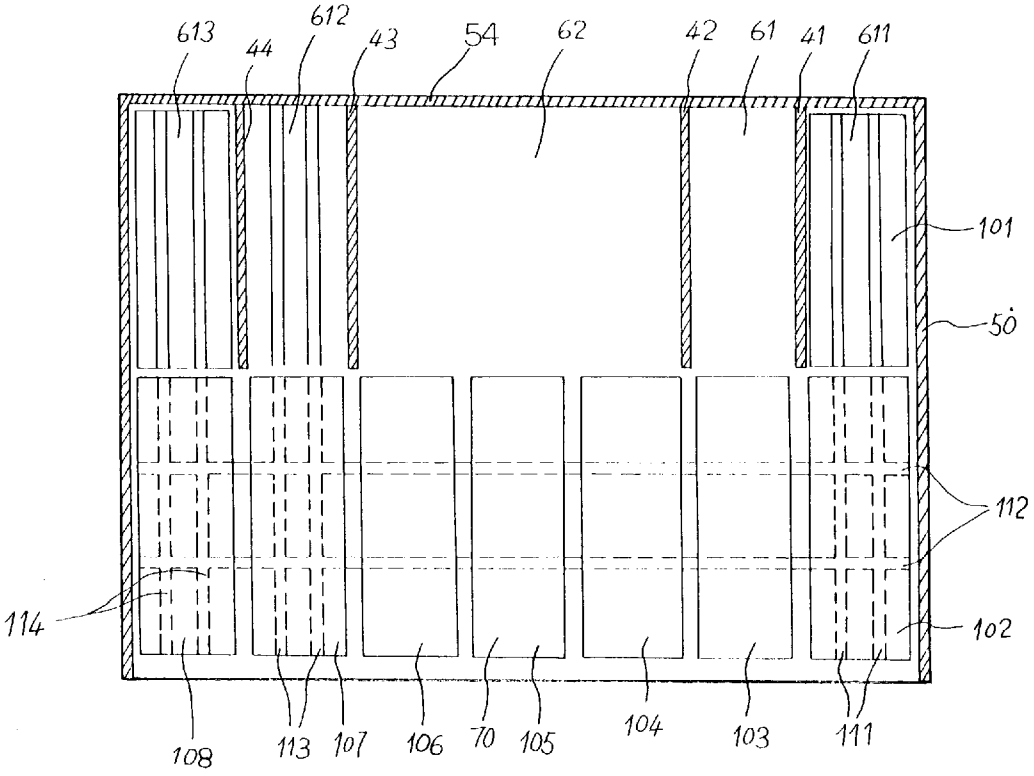
FIG. 4 is another top schematic view of the sideboard of the present invention.
Figure 5:
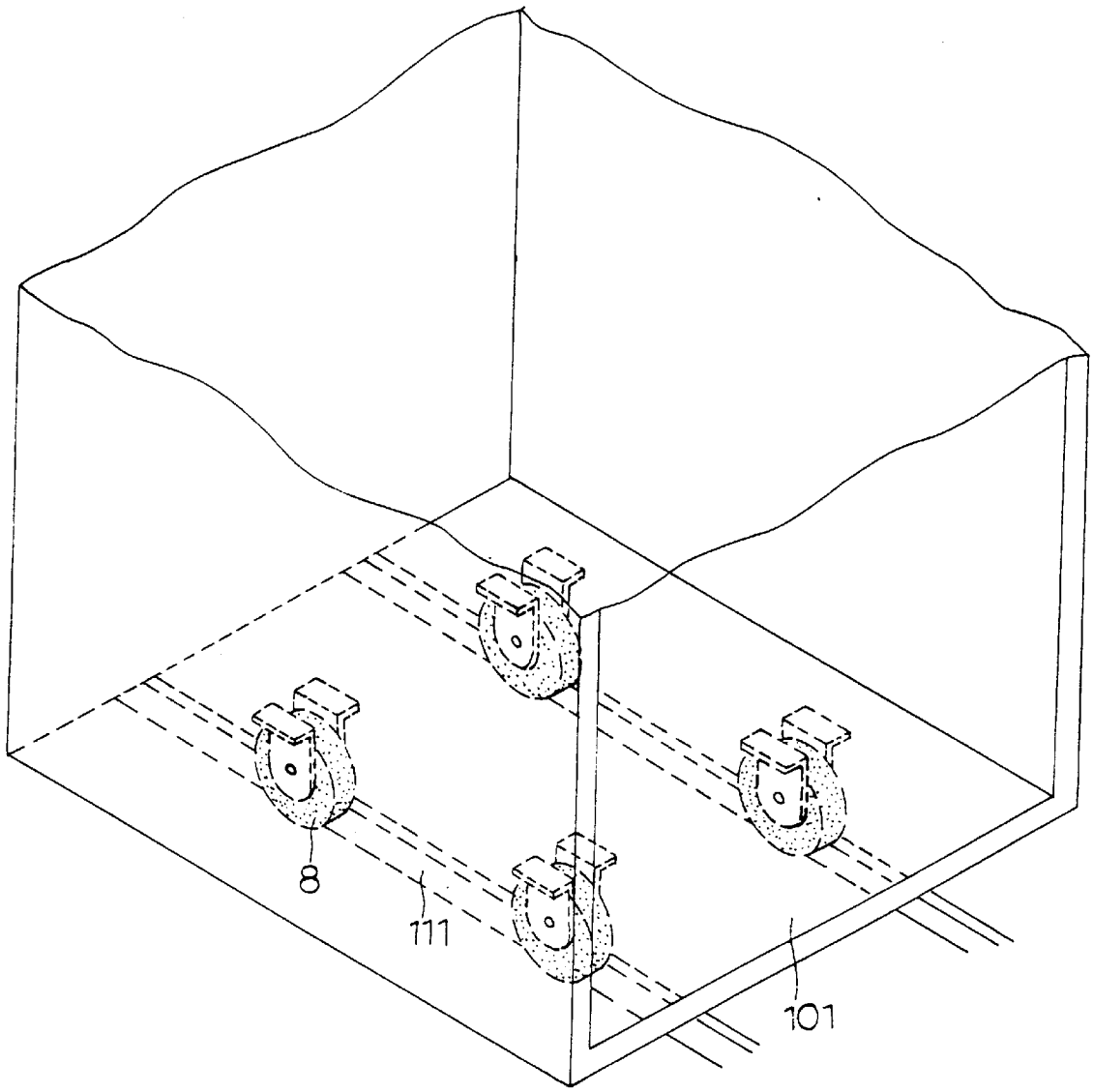
FIG. 5 is a partial perspective view of a movable cabinet according to the present invention.

Now we explain how the combination-type hiding sideboard of the present invention works. First, only the first movable cabinet 101 is in the hidden area with all the other movable cabinets are in the ornamental area. There are no movable cabinets in the third hiding chamber 613 and the second hiding chamber 612. Second, after we put precious articles in the eighth movable cabinet 108 as shown in FIG. 4, we push the eighth movable cabinet 108 into the third hiding cabinet 613, the movable cabinets 102–107 are pushed left one by one. Third, the first movable cabinet 101 moves out of the first hiding chamber 613, and then moves to the original position of the second movable cabinet 102. During the movement of the movable cabinets 102–107, other precious articles can be put into hiding areas 61 and 62. The first movable cabinet 101 and the seventh movable cabinet 107 are fixed by locks 501 and 511 so as to form a row of movable cabinets used to conceal the hiding area.

Although the present invention has been described in detail, it should be understood that various changes, substitutions and alterations can be made thereto without departing from the spirit and scope of the present invention as defined by the appended claims.

I claim:

1. A sideboard with movable hidden and visible cabinets comprising;

a) a body having a top panel with a lower surface, a middle panel having an upper surface, two opposite side panels and a seat panel connecting the top and middle panels so as to bound an interior spaced having an open front portion;

b) at least one first grooves formed in the upper surface of the middle panel and extending substantially adjacent and parallel to the open front portion;

c) at least one second grooves formed in the upper surface of the middle panel and extending substantially perpendicular to the at least one first grooves;

d) a plurality of first cabinets located in the body so as to be movable along the at least one first grooves; and, e) at least one second cabinet located in the body so as to be movable along the at least one second grooves between a first position adjacent to the open front portion of the body and a second position adjacent to the seat panel, whereby the first cabinets can be moved in front of the at least one second cabinet when in its second position to prevent viewing the at least on second cabinet from the open front portion.

2. The sideboard of claim 1 further comprising at least one panel extending into the interior space from the seat panel towards the first cabinets separating a hiding chamber and a hiding area.

3. The sideboard of claim 2 comprising a plurality of panels separating a plurality of hiding chamber and hiding areas.

4. The sideboard of claim 1 further comprising a plurality of second cabinets.

5. The sideboard of claim 1 wherein the at least one first groove comprises a pair of parallel grooves.

6. The sideboard of claim 1 wherein the at least one second groove comprises a pair of parallel grooves.

7. The sideboard of claim 1 further comprising a plurality of second grooves.

8. The sideboard of claim 7 wherein each of the plurality of second grooves comprises a pair of grooves.

9. The sideboard of claim 1 further comprising a locking device to lock one of the plurality of first cabinets to a side panel when the at least one second cabinet is in its second position.

* * * * *